United States Patent [19]

Decker et al.

[11] 4,343,616

[45] Aug. 10, 1982

[54] LUBRICANT COMPOSITIONS FOR FINISHING SYNTHETIC FIBERS

[75] Inventors: Quintin W. Decker, St. Albans; Erich Marcus, Charleston, both of W. Va.

[73] Assignee: Union Carbide Corporation, Danbury, Conn.

[21] Appl. No.: 219,217

[22] Filed: Dec. 22, 1980

[51] Int. Cl.[3] ..... D06M 13/20; D06M 15/44

[52] U.S. Cl. ..... 8/115.6; 252/89

[58] Field of Search ..... 252/8.9; 8/115.6; 106/243

[56] References Cited

U.S. PATENT DOCUMENTS

| | | | |
|---|---|---|---|
| 2,174,761 | 10/1939 | Schnette et al. | 260/458 |
| 2,677,700 | 5/1954 | Jackson et al. | 260/488 |
| 3,306,850 | 2/1967 | Olsen | 252/8.7 |
| 3,338,830 | 8/1967 | Stokes et al. | 252/8.9 |
| 3,704,225 | 11/1972 | Shay | 252/8.9 |
| 3,926,816 | 12/1975 | Cohen et al. | 252/8.9 |
| 3,963,628 | 6/1976 | Park | 252/8.9 |
| 4,019,990 | 4/1977 | Marshall et al. | 252/8.9 |
| 4,069,160 | 1/1978 | Hawkins | 252/8.9 |
| 4,111,818 | 9/1978 | Postman et al. | 252/8.9 |
| 4,134,841 | 1/1979 | Park et al. | 252/8.9 |
| 4,137,181 | 1/1979 | Hawkins | 252/8.9 |
| 4,169,062 | 9/1979 | Weipert | 252/8.9 |
| 4,252,528 | 2/1981 | Decker et al. | 8/115.6 |

*Primary Examiner*—Allan Lieberman
*Assistant Examiner*—P. Short
*Attorney, Agent, or Firm*—Henry H. Gibson

[57] ABSTRACT

Lubricant compositions for finishing synthetic fibers which exhibit improved thermal stability and low-fuming characteristics are provided which contain 50 to 90 percent by weight of a thermally stable lubricant and 10 to 50 percent by weight of an emulsifiably effective surfactant having the formula:

$$R\text{–}O\{A_aB_b\}H$$

wherein R is an alkyl having 6 to 14 carbon atoms, A is oxypropylene groups, B is oxyethylene groups, a is an integer having values of about 4 to 15, and b is an integer having values of 5 to 10.

18 Claims, No Drawings

LUBRICANT COMPOSITIONS FOR FINISHING SYNTHETIC FIBERS

BACKGROUND OF THE INVENTION

This invention pertains to lubricant compositions for finishing synthetic fibers and more particularly to such compositions containing propylene oxide/ethylene oxide block co-polymer adducts of aliphatic monohydric alcohols having 6 to 14 carbon atoms as emulsifiers.

During the conventional manufacture of synthetic continuous filament yarn, such as polyamides and polyesters, the yarn is treated with a lubricating composition usually in the form of an aqueous emulsion. Such compositions normally contain a lubricant, such as, fatty acid esters, hydrocarbon oils, and/or vegetable oils, an anti-static agent, an anti-oxidant and an emulsifier system to render the lubricant composition water emulsifiable. The complete lubricant composition should serve the processing and manufacturing needs of the fiber producer as well as the user of the synthetic yarn. The lubricant composition provides controlled lubricity (frictional properties) during yarn processing by high-speed machinery, provides proper yarn intra-frictional properties, and protects the yarn from damage during manufacturing and processing handling requirements.

For high-speed and high-temperature yarn processing, such as, hot-stretching, bulking, crimping and texturizing, the lubricant composition must function adequately at both ambient and high temperatures. In addition to the aforementioned requirements, the lubricating composition must exhibit special qualities for high-temperature processing, that is, the composition should be sufficiently stable so as not to smoke or fume nor result in the formation of varnishes or resins upon deposition onto machinery-heated surfaces. In order to meet the thermal requirements, each component of lubricating composition should possess the necessary thermal stability. However, in actual practice only some of the components fulfill the thermal prerequisites. In particular, some emulsifier systems fail to meet the thermal stability standards because of the chemical make-up of the emulsifier or emulsifiers which is designed to produce stable aqueous emulsions of lubricant composition. High fuming or smoking and/or varnish formation upon exposure to high temperature also are normally encountered with conventional surfactant used to formulate the emulsification systems. In addition, the necessity of employing more than one surfactant to achieve stable aqueous emulsions complicates the situation.

Commonly used surfactants such as alkylphenol ethoxylates, sorbitan ethoxylate esters, (hydrolyzed) vegetable oil ethoxylates, alkyl alcohol ethoxylates, fatty acid ethoxylates, and the like, do not meet all the requirements of an emulsifier in a lubricant composition for synthetic yarn. For example, the sorbitan ethoxylate esters and the (hydrolyzed) vegetable oil ethoxylates, although good emulsifiers, produce high amounts of thermo-oxidation varnishes and are high-viscosity components, a factor which is undesirable due to the direct relationship between viscosity and friction. The alkyl alcohol ethoxylates produce large amounts of smoke and require complicated combinations of surfactants to yield stable lubricant composition emulsions. The alkylphenol ethoxylates are good low-fuming emulsifiers, but create unacceptable varnishes. Compared to the other nonionic surfactants listed above, the alkylphenol ethoxylates display the best overall properties as lubricant components for synthetic yarn. Moreover, in copending application Ser. No. 25,663 filed Mar. 30, 1979, now U.S. Pat. No. 4,252,528 (Decker et al.), lubricant compositions containing a particular propylene oxide/ethylene oxide block copolymer adduct of alkylphenol is shown to exhibit acceptable high temperature and emulsifier characteristics. However, it has been found that such surfactants have a viscosity that may be less desirable for some applications and it may also be desirable from an environmental standpoint to employ surfactants that are not phenol containing.

It is therefore an object of this invention to provide synthetic yarn lubricant compositions containing emulsifiers which display the proper thermal stability, low fuming characteristics and emulsification versatility. It is a further object of this invention to provide a single non-phenol-containing surfactant having acceptable high temperature stability and resistance to varnish formation upon exposure to heated surfaces and which will emulsify conventional lubricants used in high-temperature processing of synthetic fibers.

A still further object of this invention is to provide surfactants which produce microemulsions with conventional high-temperature process lubricants.

An indication of the fuming tendencies of a substance is obtained by the measurement of the smoke point.

SUMMARY OF THE INVENTION

The objects of this invention have been satisfied by a spin finish for synthetic fibers consisting essentially of:

(A) about 50–90 percent by weight of a thermally stable lubricant selected from the group consisting of:

(1) esters of fatty acids having 12 to 18 carbons and saturated aliphatic alcohols having about 8 to 18 carbons;

(2) triglycerides of fatty acids having 12 to 18 carbon atoms;

(3) esters of a polyhydric alcohol and an alkanoic acid having about 8 to 12 carbon atoms where the polyhydric alcohol has the formula:

$$(R')_y—C—(CH_2OH)_x$$

wherein X is an integer having values of 3 or 4, R′ is alkyl having 1 to 3 carbons, y is an integer having values of 0 or 1 with the proviso that when x=4, y=0; and (4) esters of dibasic fatty acids having 2 to 18 carbons and saturated aliphatic alcohols having about 4 to 18 carbons;

(B) About 10–50 percent by weight of a surfactant having the formula:

$$R—O—(A_aB_b)—H$$

wherein R is an alkyl having 6 to 14 carbons, A is $$—CH_2—\overset{\overset{\displaystyle CH_3}{|}}{CH}O—,$$

B is $—CH_2CH_2O—$, a is an integer having values of about 4 to 15, preferably 5 to 13, and b is an integer having values of 5 to 10, preferably 6 to 9.

The lubricants used in this invention are all commercially available. The esters of fatty acids are exemplified by such esters as tridecyl stearate, hexadecyl stearate, dodecyl oleate, octyl linoleate, and the like.

Representative triglycerides include natural triglycerides, such as coconut oil, tallow oil, palm kernel oil, castor oil, and the like.

Preferred esters of a polyhydric alcohol and an alkanoic acid include trimethylolpropane tripelargonate, trimethylolethane trioctanote, pentaerythritol tetrapelargonate, and the like.

The surfactants of this invention can be made by the reaction of propylene oxide and ethylene oxide with known aliphatic monohydric alcohols having 6 to 14, and preferably 8 to 12, carbon atoms. Alcohols which may be employed are those primary straight- and branched-chain aliphatic monohydric alcohols which contain 6 to 14, and preferably 8 to 12, carbon atoms in the chain. Mixtures of the alcohols may also be used. Exemplary suitable alcohols are 2-ethylhexanol; n-heptanol; 2,6-dimethyl-1-heptanol; n-nonanol; n-decanol; n-undecanol; 2,4,4-trimethyl-1-pentanol; n-dodecanol and mixtures thereof.

In a preferred embodiment, a typical aliphatic monohydric alcohol having 6 to 14, and preferably 8 to 12, carbon atoms is converted to an alkoxide with potassium hydroxide followed by the addition first of propylene oxide to prepare a block of oxypropylene repeating units at a temperature of about 100° to 150° C. and a pressure of about 1 to 100 psig followed by the addition of ethylene oxide to incorporate oxyethylene blocks at a temperature of about 100° to 150° C. at a pressure of about 20 to 100 psig. Although the moles of ethylene oxide per mole of alcohol can vary from 5 to about 10, and preferably from about 6 to about 9, the number of moles of ethylene oxide used depends on the balance and combination of properties that are desired. It is preferred that the ratio of ethylene oxide to propylene oxide in the surfactant should not be greater than about 2.5 or less than about 0.3.

Preferred surfactants are liquids at ambient temperatures having a melting point of about 15° C. or less and viscosities at 25° C. of 150 centistokes or less.

Although the range of lubricant in the spin finish can be about 50 to 90 weight percent of the total, it is preferred to use a range of about 60 to 80 percent. Correspondingly while the surfactant can range between 10 and 50 percent of the total finish it is preferred to use 20 to 40 percent. Stated another way the mole ratio of lubricant to surfactant can vary from about 9 to 1 to about 1 to 1.

For practical application of the spin finish to synthetic fibers they are used as aqueous compositions containing about 10 to about 20 percent of the spin finish emulsified in water.

A preferred surfactant according to this invention can be characterized as having the following properties:

1. A smoke point greater than about 180° C.
2. A volatility at 200° C. of less than 12 percent per hour during a 5-hour test and a residue from the test which is a liquid.
3. A thin-film residue at 220° C. of less than 5 percent remaining after 24 hours which is a hot soapy water removable stain.
4. A viscosity of less than 200 centistokes, preferably less than 150 centistokes at 25° C.
5. A melting point of less than 15° C.
6. A cloud point (ASTM D2024-65) in a 1 percent aqueous solution greater than 5° C. but less than about 50° C.
7. An emulsification effectiveness, when mixed with appropriate lubricants, as measured by the presence of a stable emulsion at 25° C. lasting for at least 24 hours.

The invention is further defined in the examples which follow. All parts and percentages are by weight unless otherwise specified.

EXAMPLE 1

Preparation of 2-Ethylhexanol 12.6 PO (Propylene Oxide)/8.5 EO (Ethylene Oxide) Block Polymer

PREPARATION OF STARTER ALKOXIDE

In a typical experiment, 393 g. (3.0 moles) of 2-ethylhexanol was charged to a 2-liter, 4-necked, round-bottom flask equipped with a stirrer, thermowell, nitrogen purge, and heating mantle. The alcohol was heated to 40° C. with stirring, and the system was nitrogen-purged for 15 minutes. Flake 85 percent potassium hydroxide, 6.4 grams, was added and the mixture was heated to 100° C. until the KOH dissolved. In order to remove the water from the reaction, a reflux still head was added to the apparatus and the pressure was reduced to 10 mm Hg. After the water was removed at 100° C. over a one-hour period, the product was cooled and, while maintaining a nitrogen purge on the reactor, a sample, 15 grams, was removed for water analysis. Water was determined using the potentiometric Karl Fischer method. A value of 0.006 percent was obtained.

ADDITION OF PROPYLENE OXIDE (PO)

The starter alkoxide was charged to a 1.5 gal. stirred stainless steel reactor in a nitrogen atmosphere. After closing the system, 5 psig of nitrogen was put on the reactor and the contents heated to 100° C. The pressure was then adjusted to 10 psig and propylene oxide, which was previously added to the weighed feed tank, was fed to the reactor using a Lapp pump. This pump was designed to recycle liquid back into the pump feed line if the reactor did not need oxide for any reason. Propylene oxide, 2080 grams (35.9 moles), was fed at 110° C. and the pressure was allowed to increase to 60 psig with manual control of the system. Once the reaction lined out at these conditions, the system was placed on automatic control with pressure controlling oxide feed. After the PO addition was complete—after about 4 hours—the system was "cooked out" at 110° C. for 3 additional hours or to a reduced constant pressure to insure complete PO reaction and cooled.

ADDITION OF ETHYLENE OXIDE (EO)

After standing overnight, the reactor was pressurized with nitrogen to 15 psig and heated to 110° C. The pressure was adjusted to 20 psig and ethylene oxide, taken from the weighed feed tank, was fed carefully to the system. EO was fed at 110° C. and 60 psig to the reactor until the product had a cloud point of 25° C. The ethylene oxide was cooked out for 2 hours after addition was complete, and the product was cooled and discharged from the reactor in a nitrogen atmosphere to a container containing glacial acetic acid. One ml of glacial acetic acid is used for every gram of potassium hydroxide initially added.

PRODUCT WORK-UP

The alkoxylate product was neutralized in the laboratory in the same apparatus used to prepare the starter alcohol with additional glacial acetic acid under a nitrogen atmosphere to a pH of 6.8 to 6.5; pH paper in the range of 6 to 8 was used for the measurement. The product was then stripped at 100° C. and a pressure of one mm Hg for one hour to remove any unreacted oxides. Normally, less than 0.5 weight percent was removed. A clear, colorless product was obtained as kettle residue having a molecular weight of 1235 which was evaluated as a high-temperature surfactant in heat-stable finishes for texturizing polyester yarn.

EVALUATION OF THE PRODUCT

The following tests were run on the alcohol alkoxylate to demonstrate satisfactory heat-stable properties:

| | |
|---|---|
| Smoke point | 200° C. |
| Volatility | 7.2 percent per hour leaving a brown liquid residue |
| Thin-film residue on stainless steel | 1.6 percent residue which was a yellow varnish, hot soapy water removable |
| Other physical properties were: | |
| Viscosity | 139 cks (centistokes) at 25° C. |
| Specific Gravity | 1.003 at 25° C. |
| Melting Point | <−10° C. |
| Cloud Point | 25° C. |

Viscosity was determined with a Cannon-Fenske viscometer, Smoke point was determined by placing 30 ml. of product in a 50 ml. glass beaker and heating the beaker on a hot plate at a rate of 15° C./min. Using a thermometer immersed in the product and a black background, the smoke point is recorded at the temperature when the first smoke becomes visible. Volatility tests were carried out in a forced-air oven at 200° C. for 5 hours using a 10 g. sample in a Pyrex dish having an area of 20 $cm^2$.

Residue tests were carried out on a hot plate at 220° C. for 24 hours using an 0.2 g. sample on a 347 stainless steel disc having an area of 12.5 $cm^2$.

Twenty-four (24) Hour Emulsion Stability at 25° C. of textile finishes prepared using the 2-ethylhexanol 12.6 PO/8.5 EO product is shown in Table 1.

TABLE 1

EMULSION STABILITY DATA
Surfactant: 2-Ethylhexanol 12.6PO/8.5EO

| | | aqueous emulsion (a) | |
|---|---|---|---|
| | Wt./Wt. | 10% | 20% |
| Lubricant—Coconut Oil: | 80/20 | Stable (b) | Stable |
| Surfactant | 70/30 | Stable | Stable |
| Ratio | 60/40 | Stable | Stable |
| Lubricant—Trimethylolpropane Trispelargonate: | 80/20 | Stable | Stable |
| Surfactant | 70/30 | Stable | Stable |
| Ratio | 60/40 | Stable | Stable |
| Lubricant—Tridecyl Stearate: | 80/20 | Stable | Stable |
| Surfactant | 70/30 | Stable | Unstable |
| Ratio | 60/40 | Stable | Stable |

(a) Concentration of the textile finish (lubricant/surfactant mixture) in water. Emulsion prepared at 25° C. (Vol./Vol.)
(b) Stable—emulsion stable for 24 hours or longer.

EXAMPLE 2

Preparation of Dodecanol 5.5 PO/6.8 EO Block Polymer

Dodecanol (558 grams, 3.0 moles) was mixed with potassium hydroxide (4.4 grams) as described in Example 1. After water removal, propylene oxide (847 grams, 14.6 moles) was added to the reactor. After the reaction period was complete, ethylene oxide was added to the system as described in Example 1 to a cloud point of 38° C. Product work-up gave a colorless liquid having a molecular weight of 803.

EVALUATION OF THE PRODUCT

The following tests using the procedure described in Example 1 were run on the product to demonstrate satisfactory heat-stable properties:

| | |
|---|---|
| Smoke point | 180° C. |
| Thin-film residue on stainless steel | 1.2 percent residue which was a yellow varnish which was hot soapy water removable |
| Other physical properties were: | |
| Viscosity | 83 cks (centistokes at 25° C.) |
| Specific Gravity | 0.993 at 25° C. |
| Melting Point | −5° C. |
| Cloud Point | 38° C. |

The tests shown in Table 2 were carried out to show emulsion stability of textile finishes using the product of this Example.

TABLE 2

EMULSION STABILITY DATA
Surfactant: Dodecanol 5.5PO/6.8EO

| | | aqueous emulsion (a) | |
|---|---|---|---|
| | Wt./Wt. | 10% | 20% |
| Lubricant—Coconut Oil: | 80/20 | Unstable | Unstable |
| Surfactant | 70/30 | Stable (b) | Stable |
| Ratio | 60/40 | Stable | Stable |
| Lubricant—Trimethylolpropane Trispelargonate: | 80/20 | Unstable | Unstable |
| Surfactant | 70/30 | Stable | Stable |
| Ratio | 60/40 | Stable | Stable |
| Lubricant—Tridecyl Stearate: | 80/20 | Stable | Stable |
| Surfactant | 70/30 | Stable | Unstable |
| Ratio | 60/40 | Stable | Stable |

(a) Concentration of the textile finish (lubricant/surfactant mixture) in water. Emulsion prepared at 25° C. (Vol./Vol.)
(b) Stable—emulsion stable for 24 hours or longer.

CONTROL A

Preparations of Butanol 14.9 PO/8.4 EO Block Polymer

Butanol (222 grams, 3.0 moles) was mixed with potassium hydroxide (11.4 grams) as described in Example 1. After water removal, propylene oxide (2610 grams, 45 moles) was added to the reactor. After the reaction period was complete, ethylene oxide was added to the system as described in Example 1 to a cloud point of 23° C. Product work-up gave a colorless liquid having a molecular weight of 1229 with excellent heat-stability but poor emulsification properties.

EVALUATION OF THE PRODUCT

The following tests using the procedure described in Example 1 were run on the product to demonstrate the heat stability properties:

| | |
|---|---|
| Smoke point | 255° C. |
| Thin-film residue on stainless steel | 0.8 percent residue which was a |

-continued

| | |
|---|---|
| | yellow varnish which was hot, soapy water removable |
| Cloud Point | 23° C. |

The tests shown in Table 3 were carried out to show emulsion stability of textile finishes using the butanol alkoxylate product of this control example.

TABLE 3

EMULSION STABILITY DATA
Surfactant: Butanol-14.9 PO/8.4 EO

| | Wt./Wt. | aqueous emulsion (a) 10% | 20% |
|---|---|---|---|
| Lubricant—Coconut Oil: | 80/20 | Unstable | Unstable |
| Surfactant | 60/40 | Stable (b) | Unstable |
| Ratio | | | |
| Lubricant—Trimethylol-propane Trispelargonate: | 80/20 | Unstable | Unstable |
| Surfactant | 70/30 | Stable | Stable |
| Ratio | | | |
| Lubricant—Tridecyl Stearate: | 80/20 | Unstable | Unstable |
| Surfactant | 70/30 | Unstable | Unstable |
| Ratio | | | |

(a) Concentration of the textile finish (lubricant/surfactant mixture) in water. Emulsion prepared at 25° C. (Vol./Vol.)
(b) Stable—emulsion stable for 24 hours or longer

CONTROL B

Preparation of Mixed $C_{16}$–$C_{18}$ Alcohol 4.0 PO/9.5 EO Block Polymer

Epal 16–18 purchased from Ethyl Corp., which is a mixture of $C_{16}$–$C_{18}$ alcohols (536 grams, 2.0 moles) was mixed with potassium hydroxide (5.0 grams) as described in Example 1. After water removal, propylene oxide (472 grams, 8 moles) was added to the reactor. After the reaction period was complete, ethylene oxide was added to the system as described in Example 1 to give a product having a cloud point of 38° C. Product work-up gave a colorless liquid having a molecular weight of 913 that exhibited marginal heat-stability and poor emulsification properties.

EVALUATION OF THE PRODUCT

The following tests were run on the product to demonstrate heat-stability properties:

| | |
|---|---|
| Smoke point | 170° C. |
| Volatility | 6.7 percent per hour leaving a liquid residue varnish |
| Thin-film residue on stainless steel | 5.4 percent residue which was a yellow varnish that was hot soapy water removable |
| Other physical properties were: | |
| Viscosity | 120 cks (centistokes) at 25° C. |
| Viscosity | 71 cks at 100° F. |
| Specific Gravity | 0.990 at 25° C. |
| Melting Point | 11° C. |
| Cloud Point | 38° C. |

The following tests were carried out to evaluate emulsion stability of textile finishes prepared with the alkoxylate product of this control example.

TABLE 4

EMULSION STABILTIY DATA
Surfactant: $C_{16-18}$ Alcohol 4.0 PO/9.5EO

| | Wt./Wt. | aqueous emulsion (a) 10% | 15% | 20% |
|---|---|---|---|---|
| Lubricant—Coconut Oil: | 80/20 | Unstable | Unstable | Unstable |
| Surfactant | 70/30 | Unstable | Unstable | Unstable |
| Ratio | 60/40 | Stable (b) | Unstable | Unstable |
| Lubricant—Trimethylol-propane Trispelargonate: | 80/20 | Unstable | Unstable | Unstable |
| Surfactant | 70/30 | Stable | Unstable | Unstable |
| Ratio | 60/40 | Unstable | Unstable | Unstable |

(a) Concentration of the textile finish (lubricant/surfactant mixture) in water. Emulsion prepared at 25° C. (Vol./Vol.)
(b) Stable—emulsion stable for 24 hours or longer

What is claimed is:

1. A spin finish for synthetic fibers consisting essentially of:

(a) about 50–90% by weight of a thermally stable lubricant selected from the group consisting of (1) esters of fatty acids having about 12 to 18 carbons and saturated aliphatic alcohols having about 8 to 18 carbons; (2) triglycerides of fatty acids having 12 to 18 carbons; (3) esters of a polyhydric alcohol and an alkanoic acid having about 8 to 12 carbons where the polyhydric alcohol has the formula $$(R')_y—C—(CH_2OH)_x$$

wherein x is an integer having values of 3 or 4, R' is an alkyl having 1 to 3 carbons, y is an integer having values of 0 or 1 and y=0 when x=4; and (4) esters of dibasic fatty acids having 2 to 18 carbons and saturated aliphatic alcohols having about 4 to 18 carbons; and (b) about 10–50% by weight of a nonionic surfactant having the formula $$R—O—(A_aB_b)—H$$

wherein R is an alkyl having 6 to 14 carbons A is $$CH_2—\overset{\overset{CH_3}{|}}{C}HO—,$$

B is $CH_2CH_2$—O—, a and b are integers having values of about 4 to 15 and 5 to 10 respectively.

2. The spin finish of claim 1 wherein R of said nonionic surfactant is an alkyl group having 8 to 12 carbon atoms.

3. The spin finish of claim 1 wherein R—O is the residue of 2-ethylhexanol.

4. The spin finish of claim 1 wherein the lubricant is an ester of a fatty acid having 12 to 18 carbons and a saturated aliphatic alcohol having about 8 to 18 carbons.

5. The spin finish of claim 4 wherein the fatty acid is stearic acid and the alcohol is tridecyl alcohol.

6. The spin finish of claim 4 wherein the fatty acid is stearic acid and the alcohol is hexadecyl alcohol.

7. The spin finish of claim 1 wherein the lubricant is a triglyceride of fatty acids.

8. The spin finish of claim 7 wherein the triglyceride is coconut oil.

9. The spin finish of claim 1 wherein the lubricant is an ester of a polyhydric alcohol and an alkanoic acid.

10. The spin finish of claim 9 wherein the polyhydric alcohol is trimethylolpropane.

11. The spin finish of claim 1 wherein the lubricant is an ester of dibasic fatty acids having 2 to 18 carbons and saturated aliphatic alcohols having about 4 to 18 carbons.

12. The spin finish of claim 9 wherein the polyhydric alcohol is pentaerythritol.

13. Method of lubricating synthetic yarns which comprises contacting said synthetic yarns with an aqueous emulsion containing about 10 to about 20 percent based on the weight of the total solution of a spin finish consisting essentially of:

(a) About 50–90% by weight of a thermally stable lubricant selected from the group consisting of (1) esters of fatty acids having about 12 to 18 carbons and saturated aliphatic alcohols having about 8 to 18 carbons; (2) triglycerides of fatty acids having 12 to 18 carbons; (3) esters of a polyhydric alcohol and an alkanoic acid having about 8 to 12 carbons where the polyhydric alcohol has the formula $$(R')_y—C—(CH_2OH)_x$$

wherein x is an integer having values of 3 or 4, R′ is an alkyl having 1 to 3 carbons, y is an integer having values of 0 or 1 and y=0 when x=4; and (4) esters of dibasic fatty acids having 2 to 18 carbons and saturated aliphatic alcohols having about 4 to 18 carbons; and (b) about 10–50% by weight of a surfactant having the formula $$R—O—(A_aB_b)—H$$

wherein R is an alkyl having 6 to 14 carbons A is $$CH_2—\overset{\overset{CH_3}{|}}{C}HO—,$$

B is $—CH_2CH_2—O—$, a and b are integers having values of about 4 to 15 and 5 to 10 respectively.

14. Method claimed in claim 13 wherein the spin finish consists essentially of about 60–80% by weight of lubricant and about 20–40% by weight of surfactant.

15. Method claimed in claim 13 wherein the lubricant is coconut oil and the surfactant is a 2-ethylhexanol based propylene oxide/ethylene oxide block copolymer containing about 11 to 13 moles of propylene oxide and about 7 to 9 moles of ethylene oxide per mole of 2-ethylhexanol.

16. Method claimed in claim 13 wherein the lubricant is tridecyl stearate.

17. Method claimed in claim 13 wherein the lubricant is trimethylolpropane tripelargonate.

18. Method claimed in claim 13 wherein the lubricant is pentaerythritol tetrapelargonate.

* * * * *